US005607292A

United States Patent [19]

Rao

[11] Patent Number: 5,607,292

[45] Date of Patent: Mar. 4, 1997

[54] ELECTROMAGNETIC DISK PUMP

[76] Inventor: Dantam K. Rao, 2212 Lynnwood Dr., Schenectady, N.Y. 12309

[21] Appl. No.: 504,394

[22] Filed: Jul. 19, 1995

[51] Int. Cl.[6] ..... F04B 17/04

[52] U.S. Cl. ..... 417/417; 417/410.1

[58] Field of Search ..... 417/410.1, 413.1, 417/417

[56] References Cited

U.S. PATENT DOCUMENTS

| | | | |
|---|---|---|---|
| 1,927,617 | 9/1933 | Schmidt . | |
| 2,230,273 | 2/1941 | Smith . | |
| 2,669,937 | 2/1954 | Presentey . | |
| 3,029,743 | 4/1962 | Johns | 417/413.1 X |
| 3,070,024 | 12/1962 | Romberg | 417/417 |
| 3,381,623 | 5/1968 | Elliott . | |
| 3,500,079 | 3/1970 | Barthalon | 417/417 X |
| 3,819,305 | 6/1974 | Klochemann et al. . | |
| 4,015,912 | 4/1977 | Kofink . | |
| 4,786,240 | 11/1988 | Koroly et al. . | |
| 4,915,017 | 4/1990 | Perlov . | |
| 5,011,380 | 4/1991 | Kovacs . | |
| 5,222,878 | 6/1993 | Osada et al. . | |
| 5,286,176 | 2/1994 | Bonin . | |
| 5,330,330 | 7/1994 | Kuwabara et al. . | |
| 5,340,288 | 8/1994 | Mikiya et al. . | |
| 5,352,101 | 10/1994 | Morinigo et al. | 417/410.1 |
| 5,354,185 | 10/1994 | Morinigo et al. | 417/410.1 |

OTHER PUBLICATIONS

Eric Pepe, "Guidelines for Selecting Small Pumps", Machine Design, Penton Publishing Company, Cleveland, Ohio, 1991.

"Diaphragm Compressors", Burton Corblin North America Inc., Horsham, Pennsylvania.

"Diaphragm Compressors", bulletin HP–400, Pressure Product Industries Inc., Warminster, Pennsylvania.

"Metal Diaphragm Compressors", bulletin 3.1, Fluidtron Inc., Ivyland, Pennsylvania.

Siggy Mueller, "When It's Miniature There is No Generic Pump", ASF incorporated, Norcross, Georgia.

*Primary Examiner*—Richard E. Gluck
*Attorney, Agent, or Firm*—Richard C. Litman

[57] ABSTRACT

An electromagnetic disk pump which has a reciprocating member in the form of a rigid ferromagnetic disk. An elastomeric spring, in the form of a short cylindrical tube, is interposed between the reciprocating disk and an electromagnet. The elastomeric spring seals the space between the rigid disk and the electromagnet, thus forming the pump chamber. The electromagnet is used to vibrate the reciprocating disk thereby pumping the fluid contained within the pump chamber. Check valves regulate the fluid flow through the inlet and outlet of the pump chamber.

11 Claims, 4 Drawing Sheets

(a) applied current (b) resulting displacement (c) attraction force (d) check valve positions (e) pressure wave

ELECTROMAGNETIC DISK PUMP

BACKGROUND OF THE INVENTION

1. Field of the Invention

The present invention relates to electromagnetic reciprocating fluid pumps used in medical, refrigeration, environmental, automotive and other industrial applications.

2. Description of the Prior Art

Electromagnetic reciprocating pumps, also called solenoid pumps or linear pumps for use in medical, refrigeration, environmental, automotive and other industrial applications, have been known in the prior art. This type of pump, described for example by Mikiya et al. in U.S. Pat. No. 5,340,288, uses a piston-in-cylinder approach. In this approach, a reciprocating ferromagnetic piston is placed inside the bore of a cylinder. Check valves direct the flow of fluid, and an electromagnet is used to cause the ferromagnetic piston to reciprocate. But such a piston-in-cylinder approach has several problems associated with it. Because the piston is dimensioned to seal the cylinder bore in cooperation with a piston ring or a clearance seal, there is always a tendency for the piston and ring to contact and rub against the bore of the cylinder. The rubbing of the reciprocating piston and/or its ring against the bore, causes a substantial amount of wear on the piston, ring, and cylinder bore. As a result, the life of the pump will be limited. Further, such pumps are usually equipped with a coil spring for returning the piston to its original position after it has been displaced by the magnetic force exerted by the electromagnet. Such springs are subject to failure from metal fatigue induced by the continual flexing of the coils, thus introducing an additional source of possible mechanical failure and consequently reducing the life and reliability of the pump. Other prior art documents also show this type of electromagnetic reciprocating pump.

U.S. Pat. No. 5,330,330, issued to Kuwabara et al., and U.S. Pat. No. 5,222,878, issued to Osada et al., show pumps which use an electromagnet to cause reciprocating movement of a piston.

Pumps using a flexible diaphragm to replace the reciprocating piston, in order to reduce the sources of potential mechanical failure, have been proposed in the prior art.

U.S. Pat. No. 3,381,623, issued to Elliott, shows a pump that is electromagnetically actuated. The Elliott pump has a paramagnetic diaphragm which is moved by the action of an electromagnet.

U.S. Pat. No. 4,015,912, issued to Kofink, shows automotive fuel pump that is electromagnetically actuated. The Kofink pump has a tubular core through which a rod attached to the diaphragm passes.

U.S. Pat. No. 4,786,240, issued to Koroly et al., shows an artificial heart with an electromagnet housed in the diaphragm separating the chambers of the heart.

U.S. Pat. No. 4,915,017, issued to Perlov, shows a pump that uses a bi-stable circular diaphragm. In one embodiment a ferromagnetic core is embedded in the diaphragm and is used to initiate movement of the diaphragm.

U.S. Pat. No. 5,011,380, issued to Kovacs, shows an electromagnetic left-ventricular assist device which has a magnet attached to its diaphragm.

Pumps using diaphragms however, still suffer from certain drawbacks. In these pumps, the reciprocating piston is replaced with a flexible ferromagnetic diaphragm. This diaphragm is attached to the casing at its outer periphery and is positioned to face the electromagnet's poles. In this configuration, while vibrating, a diaphragm sweeps only a conical shaped space and hence offers a significantly smaller swept volume compared to a same sized reciprocating piston pump. As a result the flow rate, at a given vibration frequency, will be smaller relative to a same sized reciprocating piston pump. In addition, the large deflections cause large bending stresses in the diaphragm. These bending stresses are cyclic in nature and limit the fatigue life of the diaphragm.

Some of the prior art pumps, such as U.S. Pat. No. 1,927,617 issued to Schmidt, U.S. Pat. No. 2,669,937 issued to Presentey, and U.S. Pat. No. 3,819,305 issued to Klochemann et al., use a flexure/piston combination to prevent the friction and wear normally associated with piston rings. In this type of pump, a flexible annular ring-shaped diaphragm (called a flexure) is attached to the outer periphery of the reciprocating piston, obviating the need for sealing rings around the piston. However, such a flexure/piston approach also has several disadvantages. A large linear movement of the piston, needed to obtain high flow rates, creates large bending stresses in the flexure. These large bending stresses are typically several tens of thousands of pounds per square inch in magnitude and reduce the fatigue life of the flexure. In addition, the flexure has to be provided with several holes, used for clamping the flexure to the casing, which raise the stresses even further. Further, because flexures tend to impart a wobbling motion to the reciprocating piston, the reciprocating piston executes a complex cocking motion that is different from straight-line motion. The fatigue life of the flexure is further reduced as the flexure is forced to periodically conform to this complex cocking motion.

Other prior art pumps use a flexible diaphragm clamped between the pump chamber and the crankcase forming a leak-tight seal between the two. A rotating eccentric driven by a motor then causes the reciprocating motion of a piston which in turn causes the reciprocating motion of the diaphragm. Check valves control the flow into and out of the pumping chamber. The article "Guidelines for Selecting Small Pumps", by Eric Pepe, appearing in Machine Design, published by Penton Publishing Company of Cleveland, Ohio, 1991, shows a typical diaphragm compressor or pump in which a piston acts directly on the diaphragm.

Also known in the prior art are pumps that use a hydraulic drive to cause the reciprocating motion of a metallic diaphragm. The metallic diaphragm in this type of pump isolates the process fluid from the hydraulic fluid within the pump chamber, effectively partitioning the pump chamber into a hydraulic fluid side and a process fluid side. The reciprocating action of the diaphragm is developed by a reciprocating piston driven by a motor. The piston reciprocates in a cylinder that is part of a hydraulic circuit which includes the hydraulic fluid side of the pump chamber. The reciprocating movement of the piston causes hydraulic fluid to move into and out of the hydraulic fluid side of the pump chamber, thus imparting reciprocating movement to the diaphragm. Product literature entitled "Diaphragm Compressors", by Burton Corblin North America Inc. of Horsham, Penn., bulletin HP-400 entitled "Diaphragm Compressors", by Pressure Product Industries Inc. of Warminster, Penn., and bulletin 3.1 entitled "Metal Diaphragm Compressors", by Fluidtron Inc. of Ivyland, Penn., show typical hydraulically driven diaphragm fluid moving machinery.

These mechanically driven diaphragm pumps also suffer from the drawback of having too many moving parts leading to a great number of sources of potential mechanical failure.

Other examples of devices using electromagnets to drive a diaphragm have been disclosed in prior patents, however none disclose the unique elastomeric spring used in the pump of the present invention.

U.S. Pat. No. 2,230,273, issued to Smith, shows a submarine acoustic device having a metal diaphragm vibrated by an electromagnet.

Another example of an electromagnetic pump is shown in U.S. Pat. No. 5,286,176, issued to Bonin. The Bonin pump uses electromagnetically driven rollers to squeeze fluid along a flexible tube disposed between the rollers and an arcuate housing.

None of the above inventions and patents, taken either singly or in combination, is seen to describe the instant invention as claimed.

SUMMARY OF THE INVENTION

The present invention is directed to an electromagnetic disk pump which has a reciprocating member in the form of a rigid ferromagnetic disk. An elastomeric spring, in the form of a short cylindrical tube, is interposed between the reciprocating disk and an electromagnet. The elastomeric spring seals the space between the rigid disk and the electromagnet, thus forming the pump chamber. The electromagnet is used to vibrate the reciprocating disk thereby pumping the fluid contained within the pump chamber. Check valves regulate the fluid flow through the inlet and outlet of the pump chamber.

Since magnetic fields do not fail and since this invention eliminates a large number of failure-prone components, such as pistons, bearings, seals, eccentrics, etc., the pump of the present invention will have a long life, be less expensive to build than prior art pumps, and be smaller than existing systems. The use of a rigid ferromagnetic disk results in a larger swept volume. As a result the flow rate will be higher for a given pump cyclic rate compared to a diaphragm pump of the same overall size. In addition, the use of compression type of stresses in the elastomeric spring as opposed to bending type of stresses in the diaphragm results in greatly lowered stresses. Since these stresses in the elastomeric spring are significantly below its fatigue strength, it will last longer, thus making the pump more reliable.

Accordingly, it is a principal object of the invention to provide an electromagnetic pump with as few moving parts as possible.

It is another object of the invention to provide an electromagnetic pump having the largest possible stroke volume for a given overall size.

It is a further object of the invention to provide an electromagnetic pump design which minimizes stresses and the possibility of fatigue related failure in its flexible components.

It is a further object of the invention to provide an electromagnetic pump design which eliminates friction between the parts and related wear, thereby increasing the operational life of the pump.

Still another object of the invention is to provide an electromagnetic pump design which eliminates bending stresses in its flexible components.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
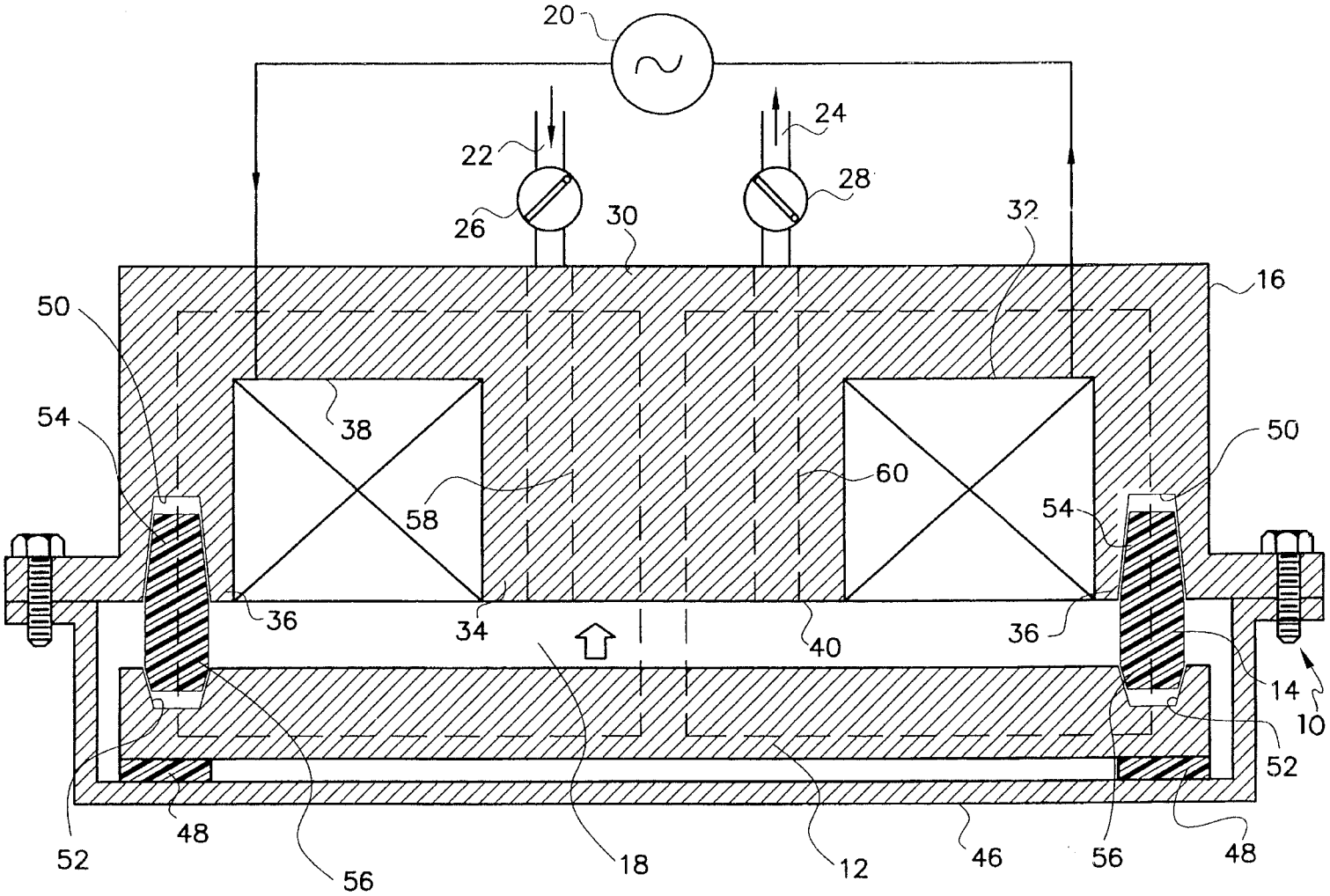
FIG. 1 is an elevational cross sectional view of the electromagnetic pump of the present invention.

Referring to FIGS. 1–4, the present invention is an electromagnetic pump 10 which includes a rigid circular disk 12, an elastomeric spring 14, and an electromagnet 16. The pump 10 uses an electromagnet 16 to vibrate a rigid ferromagnetic disk 12 to pump fluid in and out of the pump chamber 18.

The elastomeric spring 14 is in the shape of a short cylindrical pipe or tube section, and fits between the rigid disk 12 and the electromagnet 16. The elastomeric spring 14 seals the space between the rigid disk 12 and the electromagnet 16 to form the pump chamber 18. The elastomeric spring is made of a flexible elastomeric material such as rubber, and readily deforms to allow the disk 12 to move toward electromagnet 16 under the influence of the attractive force exerted by the electromagnet on the disk 12 when the electromagnet is energized.

The electromagnet 16 is energized by a driver 20 that is external to the pump. The electromagnet 16, when energized, develops an attraction force which moves the rigid disk 12 toward the electromagnet 16, thus compressing any fluid trapped in the pump chamber 18. As the disk 12 moves toward the electromagnet 16 the fluid trapped in the pump chamber 18 is pressurized. When the pressure in the pump chamber 18 becomes greater than the fluid pressure at both the inlet 22 and the outlet 24, the inlet valve 26 is closed and outlet valve 28 is open, and fluid will be ejected from the pump chamber 18 through outlet 24. During this ejection phase, the elastomeric spring 14 is compressed and stores potential energy. De-energizing electromagnet 16 allows disk 12 to return to its original position under the influence of the force exerted by the elastomeric spring 14. During this phase, the pressure within pump chamber 18 drops allowing inlet valve 26 to open and fluid from the inlet 22 to fill pump chamber 18. The drop in pressure within pump chamber 18 also causes outlet valve 28 to close, thus preventing backflow from the outlet 24 into the pump chamber 18.

The electromagnet 16 consists of a soft-iron core 30 and a coil 32. The core contains a central pole 34 and an outer pole 36. The annular slot 38 between these two poles is filled by a hermetically sealed coil 32. A driver 20 applies oscillatory current into the coil 32, thus periodically energizing the poles 34 and 36. The circuit 20, which drives pump 10 can be of a direct drive type or of a resonant drive type. The direct drive applies a half-sinusoidal pulse of current to attract the disk 12 during the compression stroke. The resonant drive incorporates a tuned RLC circuit to resonate the disk 12, thereby consuming less power. In this type of drive, the only power consumed is the ohmic losses due to the resistance in coil 32. The direct drive approach is used in the example illustrated herein and is described in greater detail below.

The elastomeric spring 14 is in the form of a cylindrical wall extending between the disk 12 and the electromagnet 16. The elastomeric spring 14 has wedge shaped ends 54 and 56 which seat within tapering grooves 50 and 52, respectively. Groove 50 is annular and is provided in the outer periphery of surface 40 of electromagnet 16. Groove 50 is tapering in cross section, being wider at the mouth than at the bottom. Groove 52 is annular and is provided in the outer periphery of the surface of disk 12 facing surface 40 of electromagnet 16. Groove 52 is tapering in cross section, being wider at the mouth than at the bottom.

Channels 58 and 60 provide fluid communication between pump chamber 18 and one-way valves 26 and 28, respectively. Although in the illustrated example the channels 58 and 60 are shown to pass through a middle portion of the core 30, the channels 58 and 60 can be provided in any desired location and orientation. For example, the channels may be made in a raised peripheral rim provided on surface 40, in the elastomeric spring 14, or in the disk 12.

The housing or casing 46 and the cushions 48 are assembled such that the cushions exert a small initial preload on the disk 12. This preload force supplies the seating pressure that is necessary to seat and seal the wedge shaped ends 54 and 56 of elastomeric spring 14, within grooves 50 and 52, respectively.

Figure 3:
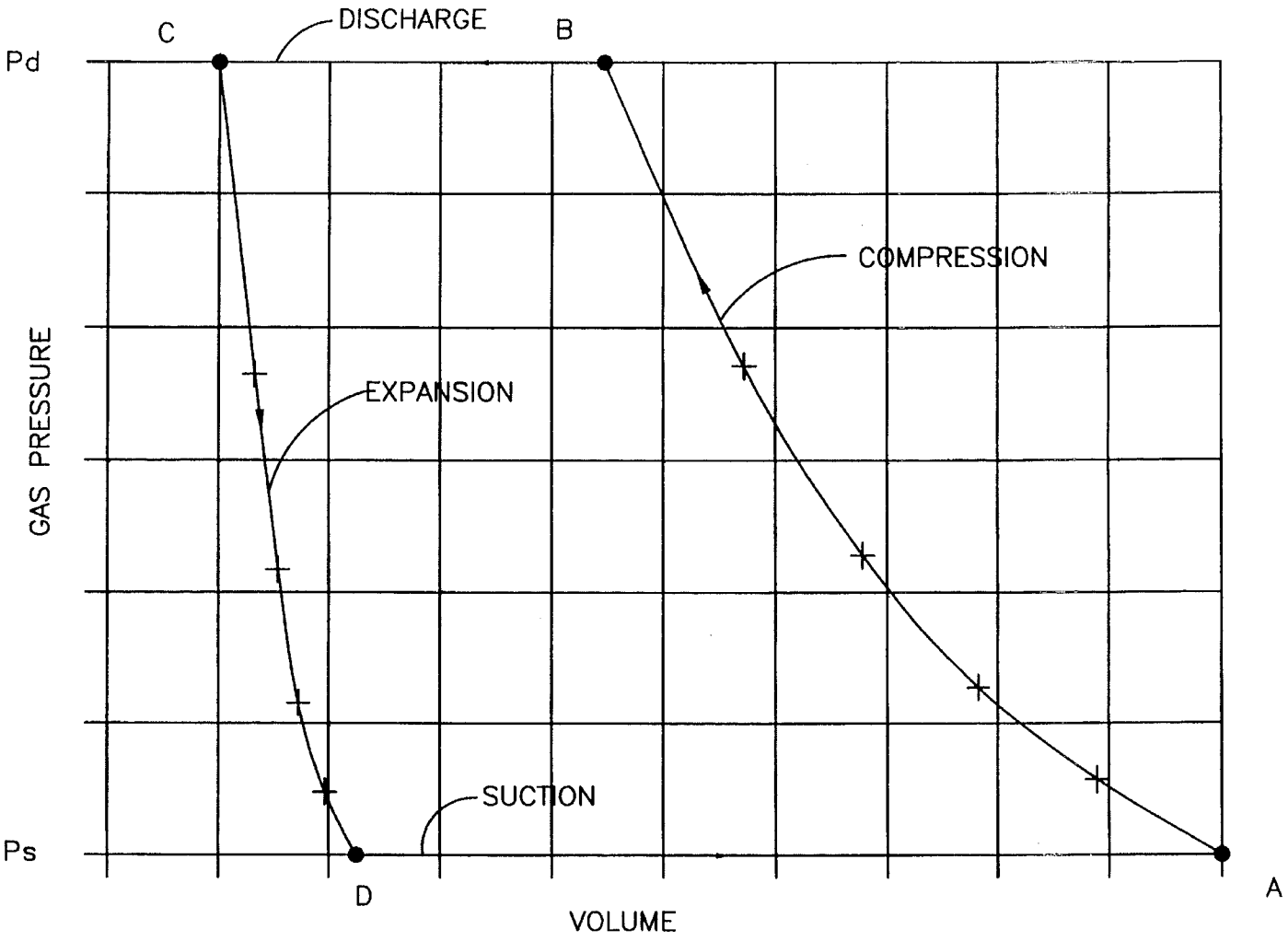
FIG. 3 is a graph showing the operating cycle of the pump of the present invention.

As shown in FIG. 3 (the PV diagram), the pumping cycle comprises of a compression phase AB, a discharge phase BC, an expansion phase CD and a suction phase DA.

The compression phase is described by the curve AB. Initially the disk 12 is at the farthest position from the surface 40 of electromagnet 16, labeled as A in the PV diagram of FIG. 3. At this point, both the inlet check valve 26 and discharge check valve 28 are closed, trapping the fluid in the pump chamber 18. During this phase, the electromagnet 16 is energized and attracts the disk 12 toward itself, thereby causing the disk 12 to move from position A to position B. As the disk 12 moves, the fluid pressure builds up from suction pressure $P_s$ to discharge pressure $P_d$.

The discharge phase is described by line BC. In this phase, the disk moves from the intermediate position B to the position C at which disk 12 is closest to surface 40 of electromagnet 16. At the point B, the discharge valve 28 opens (the inlet valve 26 continues to remain closed). During this phase, the attraction force is essentially constant and causes the compressed fluid to discharge (through the discharge valve 28) into the outlet 24.

The expansion phase is described by line CD. In this phase, the disk 12 springs back from the position closest to surface 40, labeled C in FIG. 3, to an intermediate position D. During this phase, both the inlet valve 26 and the discharge valve 28 are closed, and the electromagnet 16 is de-energized. As the disk 12 moves, the residual fluid trapped in the dead space of the pump chamber 18 expands from the position C to the position D in accordance with the adiabatic law. The elastomeric spring 14 forces the disk 12 to spring back. The pressure drops to the suction pressure value $P_s$. The suction phase is described by line DA. During this phase, the disk moves back from position D to the initial position A. The inlet valve 26 opens at the point D while the discharge valve 28 remains closed. As the disk 12 moves from the position D to A, the fluid gets sucked into the pump chamber 18 at the suction pressure $P_s$.

At the point A, the inlet valve 26 is then closed, and so also is the discharge valve 28. The pump then repeats the compression, discharge, expansion, and suction phases as described above.

Figures 4A, 4B, 4C, 4D, 4E:
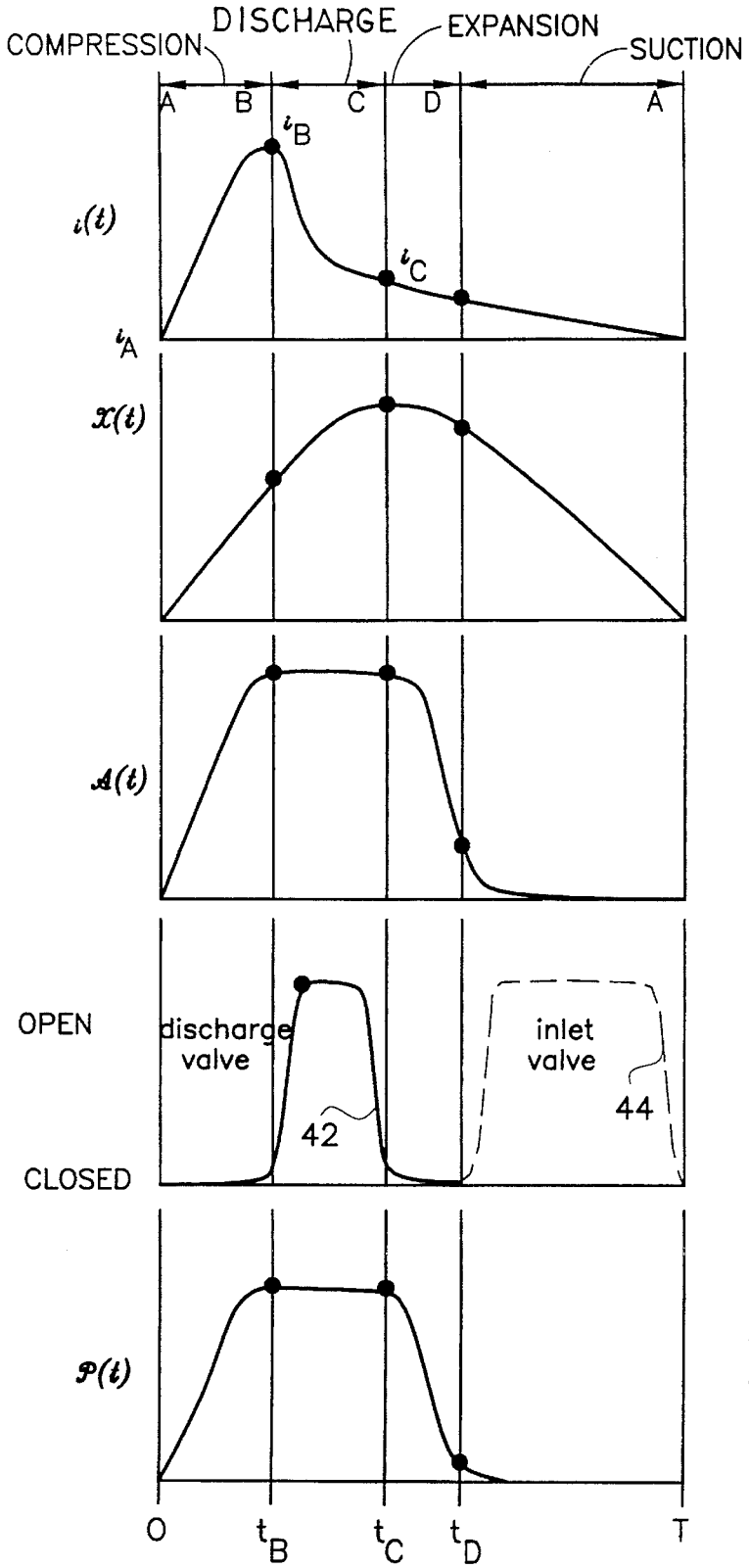
FIG. 4 is a timing diagram showing some of the operational parameters of the pump as functions of time.

The shape of the current wave form i(t), supplied to the electromagnet 16, is critical to the efficient operation of the pump of the present invention. FIG. 4 shows the applied current, the displacement of disk 12, the attractive force due to electromagnet 16, the check valve positions, and the pressure within pump chamber 18 as functions of time.

FIG. 4 shows the sequence of events beginning at time zero (t=0), the beginning of the pumping cycle, and ending at time t=T, T being the period or duration of the pumping cycle. The compression phase is the period of time from t=0 to $t=t_B$, and is referred to herein as compression phase AB. Initially, At t=0, the current $i_A$ is zero. To move the disk from position A to position B against gas pressure requires force that increases with time. Hence a rapidly increasing current is applied to the coil 32 throughout the compression phase AB. As the current rises, the disk moves forward (towards the electromagnet) thus reducing the volume of the pump chamber 18. As the disk 12 moves closer to electromagnet 16 the current necessary for generating the needed force on disk 12 is reduced. The peak current $i_B$ is selected to satisfy the force balance on disk 12 at the position B. The shape of the current wave form during compression phase AB is crafted to correspond to the adiabatic compression of fluid trapped in pump chamber 18.

The discharge phase is the period of time from $t=t_B$ to $t=t_C$, and is referred to herein as discharge phase BC. During this phase, the disk 12 will continue to move towards the electromagnet 16, thus further reducing the distance between disk 12 and surface 40 of electromagnet 16. During this phase the outlet valve 28 is open as shown by curve 42. This phase requires a force on the disk 12 that is only slightly increasing, since the outlet valve 28 is open and the pressure is constant at $P_d$. The slight increase in force is due to the compression of elastomeric spring 14. As was stated previously, the current necessary to apply a given force to disk 12 decreases as the gap between disk 12 and surface 40 is reduced. The effect of the decreasing gap between disk 12 and surface 40 is dominant during this phase. Therefore, the current needed to maintain the gas pressure constant at $P_d$ during the discharge phase will decrease with time.

The current therefore will be reduced from its peak value $i_B$ to the value $i_C$. The dead current $i_C$ is that needed to maintain the forces on disk 12 in balance at the smallest gap between disk 12 and surface 40.

During the expansion phase, the time from $t_C$ to $t_D$, and the suction phase, the time from $t_D$ to T, the electromagnet 16 is de-energized, and the disk 12 moves back due to the spring action of the elastomeric spring 14. During the suction phase the inlet valve 26 opens as shown by curve 44. At time t=T, the current completes the cycle.

The attraction force exerted by the electromagnet 16 must balance the fluid pressure, the force due to elastomeric spring 14, and the inertia of the disk 12. Therefore, the electromagnet 16 must be sized to deliver an attraction force that is significantly larger than the maximum force on disk 12 due to fluid pressure.

The design of the electromagnet is driven by the need to attain largest attraction force using the smallest current in the smallest core. The flux 70 from the coil 32 creates an inner north pole at the central pole 34 and an outer south pole at peripheral pole 36. The magnetic flux 70 from the north pole 34 induces a south pole in the center of disk 12. This magnetic flux 70 travels radially outward in the ferromagnetic disk 12 and creates a north pole at the outer periphery of disk 12. The magnetic flux 70 then travels from the outer periphery of disk 12 to outer pole 36 of electromagnet 16 thereby closing the magnetic flux circuit generated between electromagnet 16 and disk 12. The magnetic force is created by the attraction of the stationary north and south poles 34 and 36 of the electromagnet 16 for the moving south and north poles induced in the disk 12.

The design of the elastomeric spring 14 is driven by the requirement for a long life under a wide range of temperatures, pressures, and operating frequencies. In addition, the properties of the materials should not change appreciably with temperature and frequency. Further low damping, dead space reduction, and control of elastomeric spring temperature due to self-heating caused by mechanical deformation, are factored into the elastomeric spring design.

Attaining long life is made possible by using the following strategy. Typically a dynamic fatigue life of more than 2 billion cycles is needed for an elastomeric spring for use in a commercial pump. It is well known that the fatigue life of an elastomer is greatly increased by preloading it such that the stresses in it will always be unidirectional and do not change sign from compression to tension. This is accomplished in the present invention, by using the outer casing 46 and cushions 48 to limit the maximum distance, away from surface 40, to which disk 12 can move. This arrangement allows the stresses in the elastomeric spring 14 to always be maintained in a compressive state, regardless of the position of the disk 12 along its stroke length. In addition, the range of variation of the compressive stresses developed within the elastomeric spring 14, is deliberately made small relative to the compressive stress at maximum pump chamber volume. Preferably, the range of variation of the compressive stresses is less than one fiftieth of the compressive stress in elastomeric spring 14, at maximum pump chamber volume. Making the variation in stress, over the pump cycle, small relative to the overall magnitude of the stress serves to further increase the operational life of the elastomeric spring. To further reduce the stress an axially long elastomeric spring can be used. A longer elastomeric spring reduces the axial strain in the material. This, together with a low modulus of elasticity, further reduces the dynamic stresses developed within the elastomeric spring 14. By using this strategy, the dynamic stress is kept below one hundred psi. In contrast, dynamic stresses in the diaphragms used in diaphragm pumps, are several tens of thousands of psi. Using a relatively low dynamic variation in the stress, enables the elastomeric spring to attain the long fatigue life desired.

Figure 2:
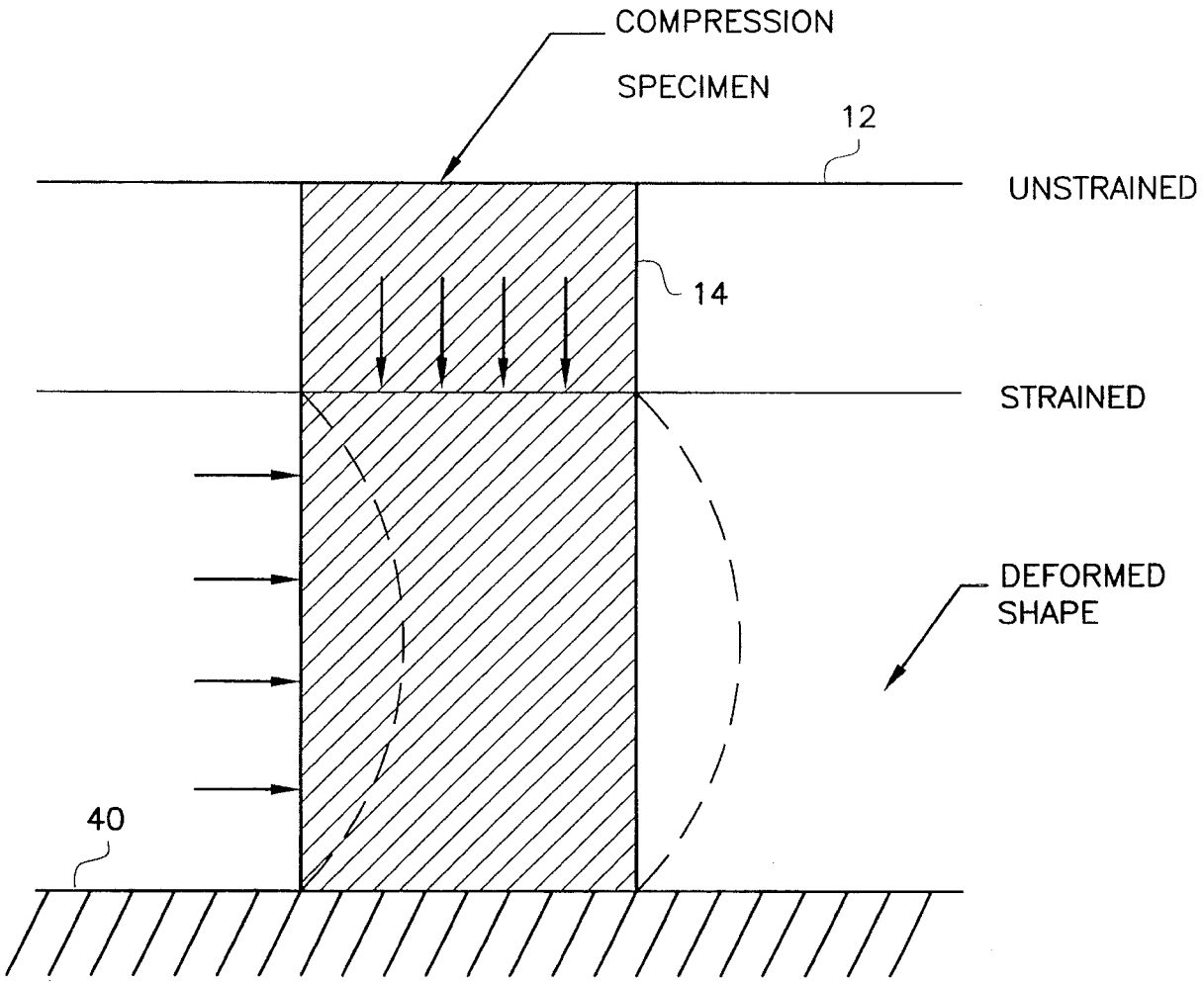
FIG. 2 is a fragmentary view showing the elastomeric spring before and after deformation.

The amount of dead space between the casing 46 and the outer surface of the pump chamber 18, is a key parameter affecting the overall size of the pump. The amount of this dead space is affected by how the elastomer is configured to seal the gap between the disk 12 and surface 40. Since most elastomeric materials are incompressible, a compression in the axial direction causes the elastomer bow outward in the radial direction as shown in FIG. 2. This bowing out or bulging effect is minimized by using tapering grooves 50 and 52 to accommodate wedge shaped ends 54 and 56, respectively, of elastomeric spring 14. The outward bulging of the elastomeric spring is reduced since the elastomeric spring tends to seat further in tapered grooves 50 and 52 when compressed, rather than bulge out as shown in FIG. 2.

It should also be noted that the dead space between the casing 46 and the outer surface of the pump chamber 18, should be vented to the atmosphere to allow atmospheric air to compensate for the variations in the volume of the pump chamber 18.

The self-heating of the elastomer is significant at high strains, but is relatively unimportant at low strains. Large vibrations give rise to dissipation of energy in the form of heat throughout the body of the elastomeric spring. As a result, the elastomer has a tendency to heat up. The temperature distribution is governed by equations of thermal conduction and boundary conditions, and is usually difficult to estimate. Since the properties of the elastomer depend upon the temperature, there is a variation of properties, caused by the variation in temperature, throughout the volume of the elastomer. The effect of this self-heating is also minimized by designing the elastomeric spring in the manner discussed earlier, which gives rise to low levels of strain in the elastomeric spring. In addition, the effects of self-heating can be further diminished by using materials that have a high heat capacity for the elastomeric spring 14.

The mode of attachment of the elastomeric spring to disk 12 and electromagnet 16, also greatly affect its stiffness and fatigue life. In order to maintain a leak-tight seal, it is imperative that the elastomeric spring is perfectly bonded to the metallic surfaces. Applying Epoxy is one method that may be used to seal the elastomeric spring. However, it has been found that epoxy subjected to vibratory stresses can fail. As a result, it is preferred to position the wedge shaped ends of the elastomeric spring inside the grooves 50 and 52, while keeping the elastomeric spring under compression at all times, to effect the sealing of the elastomer to the metallic surfaces. This technique obviates the need for using epoxy, thus eliminating the failure of epoxy by fatigue as a source of pump failure.

The sizing of the disk 12 is dictated by, among other factors, the need to minimize the inertial forces due to the disk and the need to close the flux circuit. The thickness of the disk 12 is selected so that the disk does not saturate while generating the maximum attraction force.

Although, the pump 10 has been described in the context of being used to pump a compressible fluid, i.e. a gas, it should be apparent to those of ordinary skill in the art that the pump 10 is equally applicable to the pumping of liquids.

It is to be understood that the present invention is not limited to the sole embodiment described above, but encompasses any and all embodiments within the scope of the following claims.

I claim:

1. An electromagnetic pump comprising:

an electromagnet having a first surface;

a ferromagnetic disk in registry with said first surface of said electromagnet;

an elastomeric spring in the form of a cylindrical tube extending between said first surface of said electromagnet and said ferromagnetic disk, said first surface of said electromagnet, said ferromagnetic disk, and said elastomeric spring defining an enclosed space;

inlet means for introducing fluid into said enclosed space, said inlet means in fluid communication with said enclosed space; and outlet means for ejecting fluid from said enclosed space, said outlet means in fluid communication with said enclosed space, whereby when said electromagnet is energized, said ferromagnetic disk is pulled toward said first surface of said electromagnet and fluid contained within said enclosed space is ejected through said outlet means.

2. The electromagnetic pump according to claim 1 wherein:

said inlet means includes;

an inlet passage, and an inlet valve, said inlet passage allowing fluid communication between said enclosed space and said inlet valve, said inlet valve essentially allowing fluid to pass only into said enclosed space; and said outlet means includes;

an outlet passage, and an outlet valve, said outlet passage allowing fluid communication between said enclosed space and said outlet valve, said outlet valve essentially allowing fluid to pass only out of said enclosed space.

3. The electromagnetic pump according to claim 2, wherein said elastomeric spring has a first wedge shaped end seated in a first annular groove provided in said first surface of said electromagnet, and a second wedge shaped end seated in a second annular groove provided in said ferromagnetic disk.

4. The electromagnetic pump according to claim 3, wherein said first annular groove and said second annular groove have cross sections which taper from an open mouth to a narrower flat bottom.

5. The electromagnetic pump according to claim 3, further including:

a rigid casing surrounding said ferromagnetic disk and said elastomeric spring, said rigid casing being fixed to said electromagnet, and said rigid casing ensuring that said first wedge shaped end remains seated in said first annular groove and said second wedge shaped end remains seated in said second annular groove while maintaining said elastomeric spring under compression, when said ferromagnetic disk is in a farther most position from said first surface of said electromagnet.

6. The electromagnetic pump according to claim 5, wherein said first surface of said electromagnet has an annular slot therein, and said annular slot houses a magnetic coil.

7. The electromagnetic pump according to claim 1, wherein said elastomeric spring has a first wedge shaped end seated in a first annular groove provided in said first surface of said electromagnet, and a second wedge shaped end seated in a second annular groove provided in said ferromagnetic disk.

8. The electromagnetic pump according to claim 7, wherein said first annular groove and said second annular groove have cross sections which taper from an open mouth to a narrower flat bottom.

9. The electromagnetic pump according to claim 7, further including:

a rigid casing surrounding said ferromagnetic disk and said elastomeric spring, said rigid casing being fixed to said electromagnet, and said rigid casing ensuring that said first wedge shaped end remains seated in said first annular groove and said second wedge shaped end remains seated in said second annular groove while maintaining said elastomeric spring under compression, when said ferromagnetic disk is in a farther most position from said first surface of said electromagnet.

10. The electromagnetic pump according to claim 9, wherein said first surface of said electromagnet has an annular slot therein, and said annular slot houses a magnetic coil.

11. The electromagnetic pump according to claim 1, wherein said first surface of said electromagnet has an annular slot therein, and said annular slot houses a magnetic coil.

* * * * *